US006969300B2

(12) United States Patent
Himmer

(10) Patent No.: US 6,969,300 B2
(45) Date of Patent: Nov. 29, 2005

(54) AUTOMATED PROCESSING UNIT FOR A WORKING STATION

(76) Inventor: Nina Himmer, Sevastopolsky pr-t, 24B/24, Office 411, Moscow (RU)

( * ) Notice: Subject to any disclaimer, the term of this patent is extended or adjusted under 35 U.S.C. 154(b) by 0 days.

(21) Appl. No.: 10/504,976

(22) PCT Filed: Feb. 26, 2003

(86) PCT No.: PCT/DK03/00121

§ 371 (c)(1),
(2), (4) Date: Aug. 19, 2004

(87) PCT Pub. No.: WO03/072304

PCT Pub. Date: Sep. 4, 2003

(65) Prior Publication Data

US 2005/0090183 A1 Apr. 28, 2005

(30) Foreign Application Priority Data

Feb. 28, 2002 (DK) ..... 2002 00309

(51) Int. Cl.[7] ..... B24B 1/00

(52) U.S. Cl. ..... 451/10; 451/11; 451/5; 451/184

(58) Field of Search ..... 451/5, 8, 10, 11, 451/109, 184, 336, 236

(56) References Cited

U.S. PATENT DOCUMENTS

| | | | | |
|---|---|---|---|---|
| 3,137,105 A | | 6/1964 | Conover | |
| 3,942,288 A | * | 3/1976 | Schmidt | 451/184 |
| 4,322,918 A | | 4/1982 | Steinback | |
| 4,615,146 A | | 10/1986 | Tassoni | |
| 4,720,937 A | * | 1/1988 | Tieche | 451/184 |
| 4,741,783 A | * | 5/1988 | Daunheimer et al. | 134/15 |
| 5,601,481 A | * | 2/1997 | Hundeb.o slashed.l | 451/178 |
| 5,759,089 A | * | 6/1998 | McCoy | 451/49 |
| 6,273,784 B1 | * | 8/2001 | Yamazaki et al. | 451/10 |
| 6,539,642 B1 | * | 4/2003 | Moriyasu et al. | 33/551 |

FOREIGN PATENT DOCUMENTS

| | | |
|---|---|---|
| CH | 687133 | 9/1996 |
| DE | 3639977 | 5/1988 |
| DE | 19852671 | 9/1999 |
| EP | 0169182 | 1/1986 |
| EP | 0458727 | 11/1991 |
| FR | 2765133 | 12/1998 |
| GB | 2174936 | 11/1986 |
| WO | 9008012 | 7/1990 |
| WO | 9946082 | 9/1999 |
| WO | 03018255 | 3/2003 |

OTHER PUBLICATIONS

Database WPI, Week 200309, Derwent, Class P55, AN 2003-096843 entitled "Welding Finishing Method . . . " of JP 2002283099 A, Oct. 2, 2002.

* cited by examiner

*Primary Examiner*—Eileen Morgan
(74) *Attorney, Agent, or Firm*—Dykema Gossett PLLC

(57) ABSTRACT

An automatic processing unit comprising a conveyor (1) extending through the automated processing unit and having a longitudinal direction and a transversal direction; and at least one working station located above the conveyor (1) for processing a workpiece (2). The working station is configured such that it can be displaced in an oblique angle in relation to both the longitudinal direction and the transversal direction of the conveyor (1).

14 Claims, 2 Drawing Sheets

AUTOMATED PROCESSING UNIT FOR A WORKING STATION

BACKGROUND OF THE INVENTION

1. Field of the Invention

The invention relates to an automated processing unit including a conveyor that extends through the automated processing unit and has a longitudinal direction and a transversal direction, and at least one working station located above the conveyor for processing a work piece.

2. The Prior Art

Such automated processing unit is known from eg GB-A-2 174 936, disclosing a sanding and polishing machine for sanding and polishing work pieces. The machine comprises a housing configured with a number of working stations in the form of sanding and/or polishing devices, an infeed conveyor extending through the housing underneath the sanding and polishing devices. The sanding and polishing devices are mounted securely in relation to the machine housing and comprise a first endless sanding/polishing belt that extends transversally to the conveyor and sands/polishes in the transversal direction of the conveyor, and three other endless sanding/polishing belts that sand/polish in the longitudinal direction of the conveyor.

When a work piece is to be processed in this machine, it is arranged on the conveyor and advanced by same through the housing with the sanding and polishing devices. If the conveyor advances at a constant rate the first transversal sanding/polishing belt does not in practice sand/polish perpendicular to the work piece, but rather under an oblique angle, the angulation of which will depend on the advancement rate of the conveyor and the rate of the sanding/polishing belt. If it is desired to sand/polish transversally to the work piece, it is necessary to temporarily discontinue the conveyor while such sanding/polishing is performed. The three remaining sanding/polishing devices that sand/polish in the longitudinal direction of the conveyor are comparatively wide and are configured for covering the entire width of the work piece. Each of these sanding/polishing devices is configured with a number of vertically adjustable platen pads, whereby a certain degree of pressure variation can be obtained across the width of the work piece, but since each sanding/polishing device is provided with one sanding/polishing belt that spans the entire width of the work piece, it is possible to obtain only small variations in the sanding/polishing pressure. In particular, these sanding polishing devices are not suitable for sanding/polishing profiles.

It is the object of the invention to provide an automated processing unit that is suitable for processing a work piece in a multitude of directions and is not, associated with the above-referenced drawbacks.

SUMMARY OF THE INVENTION

This is achieved in that the working station in the above-referenced automated processing unit is configured such that it can be displaced in an oblique angle in relation to both the longitudinal direction and the transversal direction of the conveyor.

Hereby it is accomplished that a work piece advanced on the conveyor can be processed by the working station in any relative direction, the movement of the work piece meaning that the working station is able to process the work piece longitudinally, while the option of angled displacement of the working station means that it is able to process the work piece transversally, while simultaneously it follows the work piece longitudinally. It is thus possible with an automated processing unit according to the invention to obtain a factual processing in any relative direction merely by adjusting the oblique displacement of the working device relative to the advancement rate of the work piece.

The working station is preferably configured for being displaceable in an angle of between 30° and 60° relative to the transversal direction of the conveyor, whereby it is possible to obtain a displacement rate of the working station which is reasonable compared to the advancement rate of the conveyor.

According to the preferred embodiment the working station is configured for being displaceable in an angle of 45° relative to the transversal direction of the conveyor, whereby the speed component of the working station in the longitudinal direction of the conveyor is identical to the speed component of the transversal direction of the conveyor, if the working station is to follow a transversal line on the work piece.

In practice, the working station is configured displaceably on a rail mounted above the conveyer in an oblique angle relative to both the longitudinal direction and the transversal direction of the conveyor. This kind of displaceable mounting of the working station is relatively simple and reliable.

Apart from the oblique displacement of the working station it can preferably be displaced perpendicular to the conveyor, whereby it is able to process a work piece in different heights.

According to a preferred embodiment of an automated processing unit, the working station comprises a sanding head with a rotating sanding brush that can be provided with various kinds of flexible sanding means, such as sanding paper.

Such sanding head can preferably be rotated about an axis perpendicular to the conveyor, thereby enabling it to sand a work piece in various directions.

Furthermore the sanding head can advantageously be rotated about an axis in parallel with the conveyor, thereby enabling it to sand in various angles.

The automated processing unit according to the invention is, according to a preferred embodiment, provided with a sensor unit for sensing the geometry of a work piece, a calculation and storage unit for processing and storing data concerning the geometry of the work piece, and a control unit for controlling the displacement of the working station in the light of the stored data relating to the geometry of the work piece. Hereby data about the geometry of the work piece can be entered in the automated processing unit, and the movement pattern of the working station for processing the work piece can be determined.

According to a particularly simple embodiment, the sensing unit comprises a number of resilient fingers, each of which is provided with a strain gauge that will, upon impact on the resilient fingers, emit a signal about the geometry of the work piece to the calculation and storage unit.

According to a preferred embodiment, the sensing device is located above the conveyor immediately in front of the working station. Hereby the automated processing unit can be fully automated, since the geometry of the work piece to be processed can be entered immediately before the working station initiates its processing, and therefore a pre-programming of the geometry of the work piece is not necessarily needed.

The automated processing unit according to the invention is preferably provided with a number of working stations, whereby several operations can be performed simultaneously.

The invention will now be explained in further detail with reference to the attached drawings.

DETAILED DESCRIPTION OF THE PREFERRED EMBODIMENT

Figure 1A:
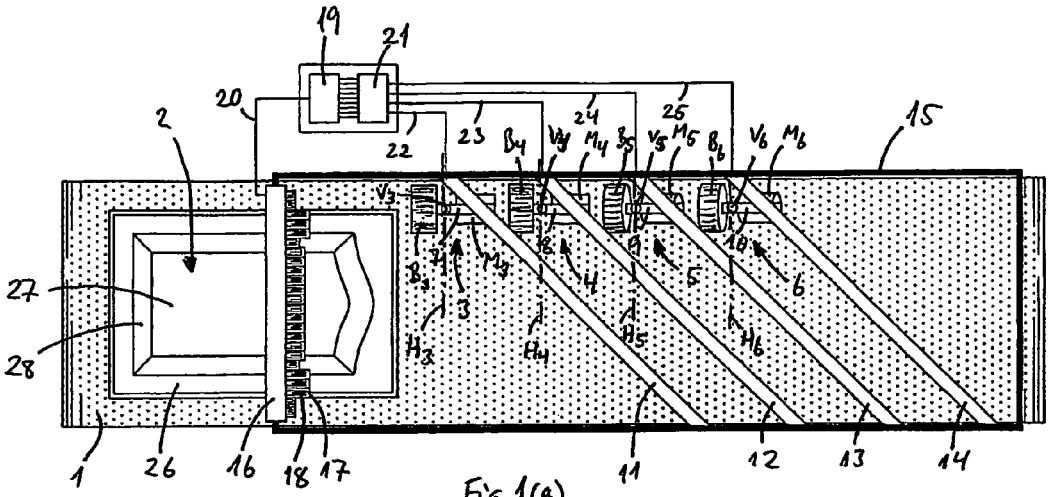
FIGS. 1(*a*)–(*c*) show an automated processing unit according to the invention seen from above in three different stages during processing of a work piece.
Figure 1B:
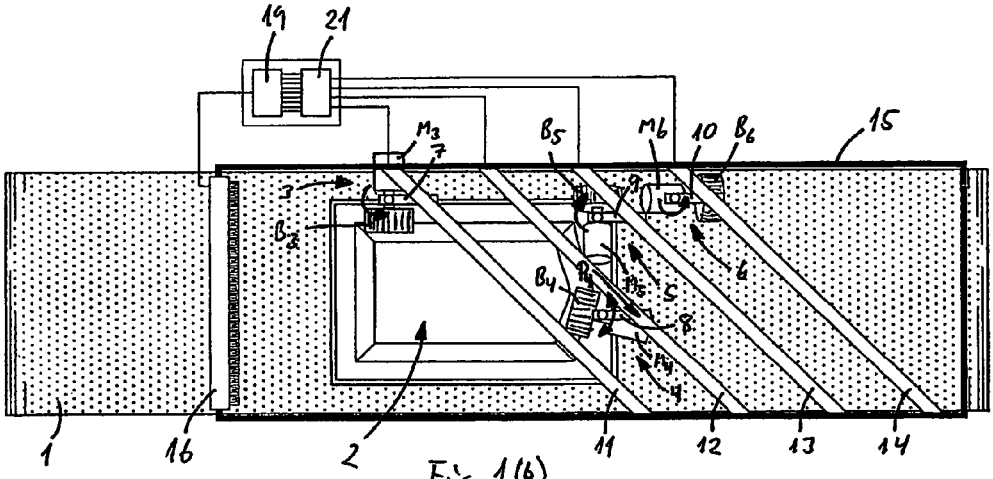
Figure 1C:
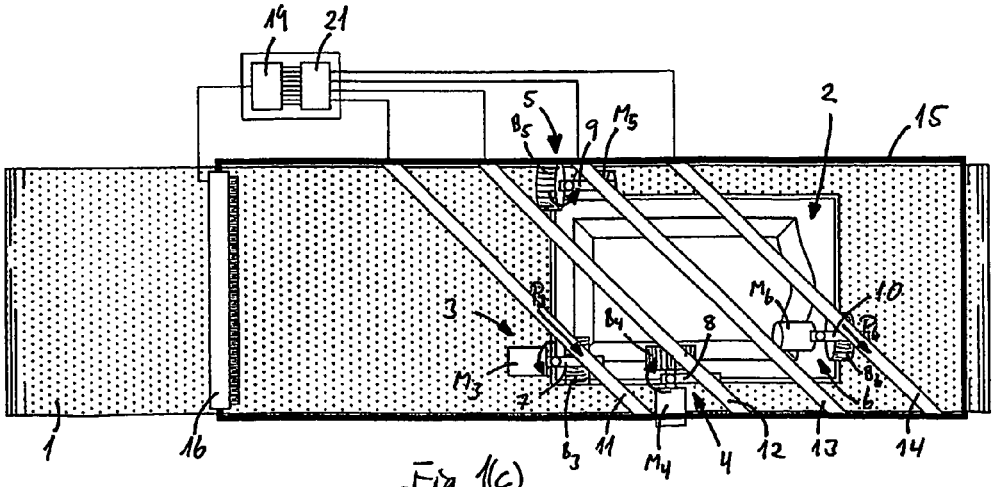

FIGS. 1(*a*)–(*c*) show an automated processing unit according to a preferred embodiment of the invention, seen from above in three different stages during processing of a work piece. The automated processing unit comprises a conveyor 1 on which a work piece 2 is located. In the example shown the work piece 2 can be a front for a kitchen cupboard, but—of course—it can be any work piece to be processed. The conveyor 1 is preferably provided with means that can secure the work piece 2, eg by means of vacuum, as it is commonly known within the field of processing plate-shaped work pieces such as kitchen fronts.

The automated processing unit also comprises a number of working stations that are, in the shown embodiment, configured with sanding heads 3, 4, 5, 6, each of which comprises a motor $M_3$, $M_4$, $M_5$, $M_6$, and a sanding device in the form of a rotating brush $B_3$, $B_4$, $B_5$, $B_6$. Each of the sanding heads 3–6 is, via a connecting arm 7, 8, 9, 10, configured displaceably on a rail 11, 12, 13, 14, that have an oblique expanse transversally to the conveyor 1. Rails 11–14 are mounted on a frame 15 that is securely mounted above the conveyor 1. In the shown embodiment each rail 11–14 forms an angle of 45° relative to the longitudinal direction of the conveyor, but this angle may be varied as desired or needed. Sanding heads 3–6 are suspended underneath rails 11–14 and they can, by suitable drive means, be displaced along same. These drive means may comprise chain haulage, toothed racks, etc., but as such they will not be described in further detail herein, a person skilled in the art being able to readily point to such means.

Apart from being displaceable along rails 11–14, each sanding head can also be rotated about a vertical axis $V_3$, $V_4$, $V_5$, $V_6$, and about a horizontal axis $H_3$, $H_4$, $H_5$, $H_6$. Hereby it is obtained that the rotating brush $B_3$–$B_6$ of each sanding head 3–6 can be adjusted to a desired position depending on the work piece to be processed. The rotation of the individual sanding head 3–6 about the vertical axis $V_3$–$V_6$ as well as the horizontal axis $H_3$–$H_6$ can be controlled either automatically during operation of the automated processing unit, or each sanding head 3–6 can be pre-set to a fixed position. According to the embodiment shown in FIGS. 1(*a*)–(*c*) the rotation of the sanding heads 3–6 about the vertical axes $V_3$–$V_6$ is controlled automatically, while the rotation about the horizontal axes $H_3$–$H_6$ is set manually before the automated processing unit is put in operation.

As will appear from FIG. 1(*a*), the sanding heads 3 and 4 are set such that their rotating brushes $B_3$, $B_4$ rotate about a horizontal axis, while the sanding heads 5 and 6 are set such that their rotating brushes $B_5$ and $B_6$ rotate about axis that inclines downwards towards the conveyor 1.

To the left in FIGS. 1(*a*)–(*c*) the frame 15 is provided with a sensing device 16 that senses the geometry of the work piece 2. The sensing device 16 comprises a number of resilient fingers 17 that are biased in place within the sensing device 16 as such, but is configured for being flexed upwards when a work piece 2 passes there below. Each resilient finger 17 is provided with a strain gauge 18 and by measuring the change in resistance therethrough, when the resilient finger 17 flexes, an expression of the thickness of the work piece 2 at precisely this point at a given time is obtained. By, as shown, using a number of such resilient fingers 17 it is, at any point in time, possible to form an "image" of the cross section of the work piece 2. In FIGS. 1(*a*)–(*c*) the sensing device is provided with 24 resilient fingers 17, but in practice there will normally be a larger number such that a more detailed image of the cross section of the work piece 2 is obtained.

The signals from the sensing device 16 are collected continuously in a calculation and storage device, such as a central computer 19, for processing and storing data concerning the geometry of the work piece via a communication line 20, and since the conveyor 1 advances the work piece 2 at a constant rate of advancement, the central computer 19 is able to form an overall image of the geometry of the entire work piece 2. This image is subsequently used to control displacement and rotation, if any, of the individual sanding heads 3–6 via a control unit 21 that will, via communication connections 22, 23, 24, 25, transmit the control signals to the displacement and rotation means on sanding heads 3–6 in a not specifically shown manner.

A person skilled in the art, however, will be able to readily point to such connections.

In operation a work piece 2, such as a kitchen front, is located on the conveyor 1. As mentioned previously, the conveyor 1 can advantageously be configured such as to secure the work piece 2 by means of vacuum, which is generally known within the art, and it will not be disclosed more detailed herein. The conveyor 1 advances at a constant rate in the direction of the arrow $P_1$ and thus advances the work piece 2 at this constant rate. First, the work piece 2 is conveyed below the sensor device 16, whereby some of the resilient fingers 17 are flexed upwards as shown in FIG. 1(*a*). The resilient fingers 17 are, as mentioned, provided with strain gauges 18 and information about the resistance changes of strain gauges 18 is collected in the central computer 19 and is used for calculating the geometry of the work piece 2 and for generating control signals for the sanding heads 3–6 in the control unit 21. It can be entered in advance on the central computer 19 which types of work pieces are to be processed, whereby the signals from the sensing device are used exclusively for determining how the work piece 2 is oriented on the conveyor 1.

Figure 2:
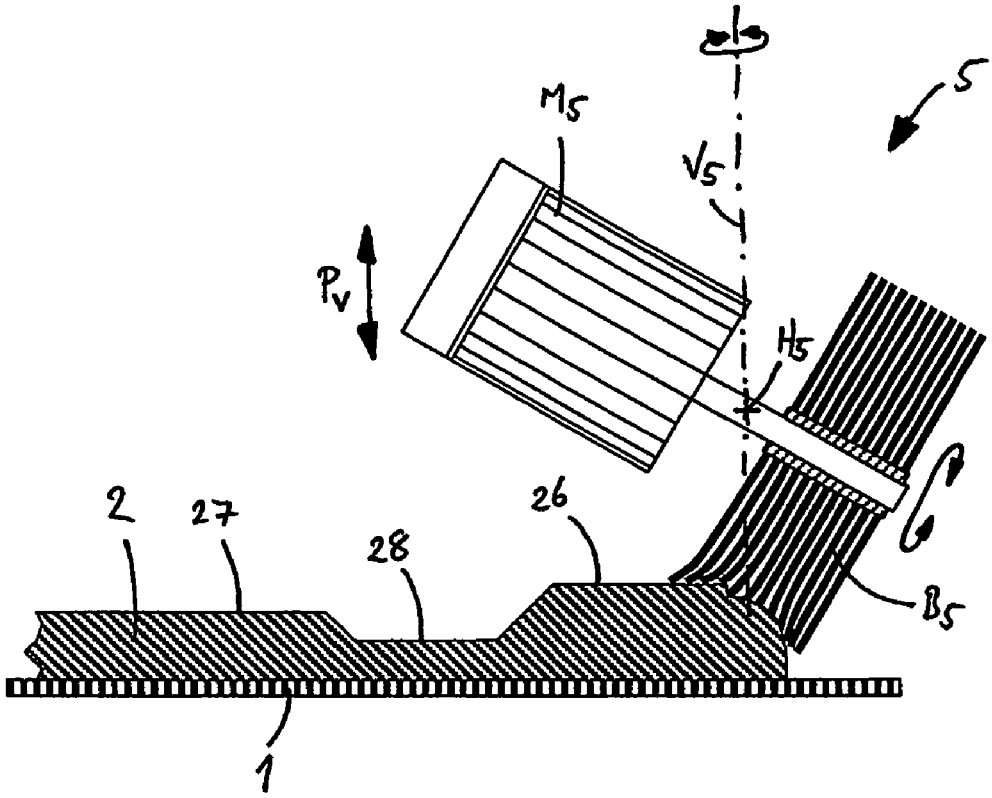
FIG. 2 schematically shows an angled sanding head on the automated processing unit in combination with a part of a work piece.

In the example shown the work piece 2 is a kitchen front of the panelled type with an outer frame 26, a central recessed-panel portion 27 and an even deeper recess 28 between the outer frame 26 and the central portion 27 (see also FIG. 2).

When, during the further advancement of the conveyor 1, the work piece 2 reaches the first sanding head 3, it is oriented such as to be able to perform a predetermined sanding of the work piece 2 FIG. 1(*b*) shows how the first sanding head 3 has been rotated 90° counter-clockwise, and it sands a longitudinally extending edge between the outer frame 26 of the work piece 2 and the recess 28. The sanding head 3 is not displaced on the rail 11, nor will it be for as long as it sands the longitudinally extending edge.

FIG. 1(*b*) further shows that the sanding head 4 sands a corresponding edge between the outer frame 26 of the work piece 2 and the recess 28; this edge, however, being curved and extending transversally to the work piece 2. In order to sand this edge, the sanding head 4 is rotated slightly such that the rotating brush $B_4$ will, at any time, sand in parallel with the edge. Moreover the sanding head 4 is displaced as outlined by the arrow $P_4$ along the rail 12, the rate of displacement being adjusted to the advancement of the work piece 2 in such a manner that the sanding head 4 will always sand in parallel with the relevant edge of the work piece 2. With the shown curved edge this means that the rate of displacement is not always constant and, likewise, the rotation of the sanding head 4 about the vertical axis $V_4$ will also vary over time. The rail 11 being configured under an inclined angle in relation to the longitudinal direction of the conveyor 1, it is possible, by suitable control, to adapt the displacement of the sanding head 4, along the rail 11 and its rotation about the vertical axis $V_4$ in such a manner that the sanding head 4 will always sand in parallel with the edge.

Now, FIG. 1(*b*) also shows that that the third sanding head 5 has been rotated 90° clockwise, thereby enabling it to sand the outer edge of the work piece 2. This sanding head 5 is, as mentioned before, slightly turned about a horizontal axis $H_5$, thereby enabling it to sand the rounded edge of the work piece 2. This is shown more in detail in FIG. 2 that shows, in an enlarged view, how the sanding head 5 is configured for sanding the outer edge of the work piece 2. It will appear that the sanding head 5 is inclined, as it is rotated about a horizontal axis $H_5$. FIG. 2 also outlines that the sanding head 5 is able to rotate about the vertical axis $V_5$ and it is outlined that the sanding head 5 can have a further option for adjustment, viz an adjustment in height perpendicular to the conveyor 1 in the direction of the double arrow $P_v$.

Now back to FIG. 1(*b*), where it is shown that the fourth sanding head 6 has been rotated 180° and is ready to sand the frontmost outer edge of the work piece 2 as shown in FIG. 1(*c*), wherein the work piece is further advanced.

From FIG. 1(*c*) it will appear how the first sanding head 1 is, after having sanded a longitudinally extending edge, rotated further 90° counter-clockwise, and that it now sands a transversally extending edge between the outer frame 26 of the work piece 2 and the recess 28. The work piece 2 being advanced at a constant rate and the given edge being straight, the sanding head 3 is also displaced along the rail 11 in the direction of the arrow $P_3$ at a constant rate of advancement, whereby it is obtained that the sanding head 3 will at all times sand in parallel with the relevant edge.

Following finished sanding of the curved edge, the second sanding head 4 is turned about 90° clockwise in order for it to sand the second longitudinally extending edge between the outer frame 26 of the work piece 2 and the recess 28. The third sanding head 5 is, after having sanded a longitudinally extending outer edge on the work piece 2, turned 90° counter-clockwise, and is ready to sand the rearmost edge on the work piece 2. Since this edge is also straight, the sanding head 5 can be displaced in the direction of the arrow $P_5$ at a constant rate along the rail 13 in order to thereby obtain that the sanding head will, at all times, sand in parallel with relevant edge.

In FIG. 1(*c*), the fourth sanding head 6, which was—as mentioned above—also turned slightly about a horizontal axis $H_6$, like the third sanding head 5, sands the frontmost rounded edge of the work piece 2 in the same manner as the third sanding head 5 sands the rearmost edge, ie by a simultaneous displacement in the direction of the arrow $P_6$.

When the work piece 2 has passed below all the sanding heads 3–5 and all the desired edges and areas have been processed, the automated processing unit is ready for another work piece 2.

In the shown preferred embodiment the displacement along the rails 11–14 of the sanding heads 3–6 and the rotation of the sanding heads 3–6 about the vertical axes $V_3$–$V_6$ are controlled by control signals from the control unit 21 that generates the signals on the basis of input from the central computer 19. The angulation of the sanding heads 3–6 about the horizontal axes $H_3$–$H_6$ and the height adjustment, if any, perpendicular to the conveyor 1 is, in the embodiment shown, adjusted manually before the automated processing unit is put in operation, but nothing prevents these adjustments from being performed continuously on the basis of control signals from the control unit 21. The motors $M_3$–$M_6$ of the sanding heads 3–6 can, in operation, rotate either at a constant rate and direction of revolution or they can be controlled by signals from the control unit.

In the example shown of an automated processing unit the working stations consist of sanding heads that are used for the sanding of portions of a work piece advanced in the automated unit. However, the automated processing unit according to the invention is not limited to this use, as the automated processing unit is able to assume other shapes within the scope of this invention, and thereby it is able to perform other types of processing of a work piece. The working stations may be configured eg as painting or varnishing devices, eg provided with spray guns, polishing devices or any other type of device capable of performing a processing of a work piece. Nor is the automated processing unit according to the invention limited to processing comparatively flat work pieces, such as kitchen fronts, as it lends itself for use just as readily for the processing of work pieces of a larger thickness, such as doors and windows. The automated processing unit according to the invention may also be configured for processing work pieces located vertically relative to the conveyor and to optionally process such work pieces on both sides at the same time.

Finally the sensing device may configured differently, eg with rollers that roll across the work piece or with optical sensing of the geometry of the work piece.

What is claimed is:

1. An automated processing unit comprising:

a conveyor moving along a plane and defining a longitudinal direction and a transversal direction;

a rail which is positioned above the conveyor and which extends at an oblique angle relative to both the longitudinal direction and the transversal direction of the conveyor; and a working station located above the conveyor for processing a work piece supported by the conveyor, the working station being mounted to and displaceable along the rail, and further being capable of moving in the longitudinal direction as the work piece is moved in the longitudinal direction on the conveyor.

2. An automated processing unit according to claim 1, wherein the rail extends at an angle of between 30° and 60° relative to the transversal direction of the conveyor.

3. An automated processing unit according to claim 2, wherein the rail extends at an angle of 45° relative to the transversal direction of the conveyor.

4. An automated processing unit according to claim 1, wherein the working station is oriented at an inclined angle relative to the plane of the conveyor.

5. An automated processing unit according to claim 1, wherein the working station can be displaced perpendicularly to the plane of the conveyor.

6. An automated processing unit according to claim 1, wherein the working station comprises a sanding head with a rotating sanding brush.

7. An automated processing unit according to claim 6, wherein the sanding head can be rotated about an axis which is substantially perpendicular to the plane of the conveyor.

8. An automated processing unit according to claim 6, wherein the sanding head can be rotated about an axis which is substantially parallel with the plane of the conveyor.

9. An automated processing unit according to claim 1, including:

a sensing device for sensing the geometry of a work piece;

a calculation and storage device for processing and storing data concerning the geometry of the work piece, and a control unit for controlling the displacement of the working station on the basis of the stored data on the geometry of the work piece.

10. An automated processing unit according to claim 9, wherein the sensing device comprises a number of resilient fingers, each of which is provided with a strain gauge.

11. An automated processing unit according to claim 9, wherein the sensing device is located above the conveyor immediately in front of the working station.

12. An automated processing unit according to claim 1, including a plurality of working stations.

13. An automated processing unit according to claim 1, further including an arm operatively connecting the working station to the rail.

14. An automated processing unit according to claim 13, including a plurality of rails positioned above the conveyor, each of said plurality of rails supporting a respective working station.

* * * * *